US009828149B2

(12) United States Patent
Wang

(10) Patent No.: US 9,828,149 B2
(45) Date of Patent: Nov. 28, 2017

(54) TAMPER-EVIDENT CONTAINER

(71) Applicant: SOUTH PLASTIC INDUSTRY CO., LTD., New Taipei (TW)

(72) Inventor: Tong-Chang Wang, New Taipei (TW)

(73) Assignee: SOUTH PLASTIC INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/404,200

(22) Filed: Jan. 12, 2017

(65) Prior Publication Data

US 2017/0121080 A1 May 4, 2017

Related U.S. Application Data

(63) Continuation-in-part of application No. 14/842,842, filed on Sep. 2, 2015, now Pat. No. 9,592,937.

(51) Int. Cl.

| | |
|---|---|
| ***B65D 43/22*** | (2006.01) |
| ***B65D 55/02*** | (2006.01) |
| ***B65D 43/16*** | (2006.01) |
| ***B65D 25/54*** | (2006.01) |
| ***B65D 85/00*** | (2006.01) |

(52) U.S. Cl.

CPC ..... *B65D 55/024* (2013.01); *B65D 25/54* (2013.01); *B65D 43/16* (2013.01); *B65D 43/22* (2013.01); *B65D 85/70* (2013.01); *B65D 2543/00842* (2013.01)

(58) Field of Classification Search

CPC ..... B65D 55/024; B65D 43/16; B65D 25/54; B65D 85/70; B65D 43/22; B65D 2543/00842

USPC ..... 220/266, 270, 789, 791

See application file for complete search history.

(56) References Cited

U.S. PATENT DOCUMENTS

2013/0160406 A1* 6/2013 Johnston ..... B65B 7/26 53/467

* cited by examiner

*Primary Examiner* — James N Smalley
(74) *Attorney, Agent, or Firm* — Leong C. Lei

(57) ABSTRACT

A tamper-evident container generally includes a tray having an opening with a step section formed around the opening and including a first protrusion section that is provided with a first coupling unit with a first perforation line formed therebetween. The first coupling unit includes a coupling trough. A cover includes a concave groove having a bottom and an outside surface engageable with the step section to close the opening. The cover includes a second protrusion section and a second coupling unit between which a second perforation line is formed and projecting beyond the first perforation line. The second coupling unit has a coupling member receivable in and engageable with the coupling trough. Tearing off the first and second perforation lines allows the first and second coupling units to detach from the tray and the cover, respectively with the second protrusion section projecting outside the tray for easy gripping.

4 Claims, 6 Drawing Sheets

TAMPER-EVIDENT CONTAINER

CROSS-REFERENCE TO RELATED APPLICATION

This is a continuation-in-part of co-pending U.S. patent application Ser. No. 14/842,842 filed on Sep. 2, 2015.

TECHNICAL FIELD OF THE INVENTION

The present invention relates generally to a tamper-evident container, which comprises a second coupling portion provided on a tray and a first coupling portion provided on a cover and are engageable with and coupleable to each other to close an opening of the tray in order to protect the tray from being picked open and are also provided with first perforation line and a second perforation so that when a force is applied between the first coupling portion and the second coupling portion, the first perforation line and the second perforation line are torn off, providing an effect of identification of unauthorized opening.

DESCRIPTION OF THE PRIOR ART

Various plastic containers that are made through vacuum forming are available, including boxes, cups, or bowls, which are fit for storage of food for keeping the food fresh. Such products are generally made of clear materials, allowing general consumers to see therethrough to observe food therein when they intend to purchase the food and this eliminates unnecessary arguing and quarrels after the sale. However, to inspect the food contained in such a container is intact and fresh, some consumers may open, without permission and authorization, the container to directly inspect the food. Some of such food containers, after being opened by the consumers, are not properly sealed to the original condition so that the food contained therein may get contaminated or spoiled. In addition, this may also lead to damage of the plastic container and affects the outside appearance of the container. Further, if it is not timely recognized that the package container has been tampered and opened, deterioration of the food contained therein would cause a waste of food and is also an economic burden of the shops.

In view of these problems, the present invention aims to provide a tamper-evident container, which provides a tamper evident effect to eliminate the drawbacks and deficiency of the prior art devices.

SUMMARY OF THE INVENTION

Thus, to prevent damage of the outside appearance of a plastic container and food contained in the container losing freshness resulting from unauthorized opening and tampering of the plastic container, the primary object of the present invention is to provide a tamper-evident container.

To achieve the above objective, the present invention generally comprises a tray, the tray having an end that forms an opening in communication with the outside, the tray comprising a receiving space formed in an interior thereof and in communication with the opening, the opening comprising a step section, the opening being extended from at least one side thereof to form a first protrusion section, the first protrusion section being provided with a first coupling unit, the first protrusion section and the first coupling unit being provided with a first perforation line formed therebetween, the first coupling unit comprising a shallow trough, a coupling trough, and a rim extending upward vertically, the coupling trough being formed inside the shallow trough, the rim being formed one a circumference of the shallow trough, the rim having an open end; and a cover, which has a top surface in which a concave groove is circumferentially formed, the concave groove having a bottom and an outside surface engageable with the step section to close the opening, the cover being extended from one side thereof to form a second protrusion section and a second coupling unit, the second protrusion section and the second coupling unit being provided with a second perforation line formed therebetween, the second coupling unit having a bottom comprising a coupling member formed thereon and projecting therefrom, the coupling member being receivable in and engageable with the coupling trough with the second perforation line extending beyond and outside of the first perforation line, wherein tearing off the first perforation line and the second perforation line allows the first coupling unit and the second coupling unit to detach from the tray and the cover, respectively and also allows the second protrusion section projecting outside the tray for easy gripping.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
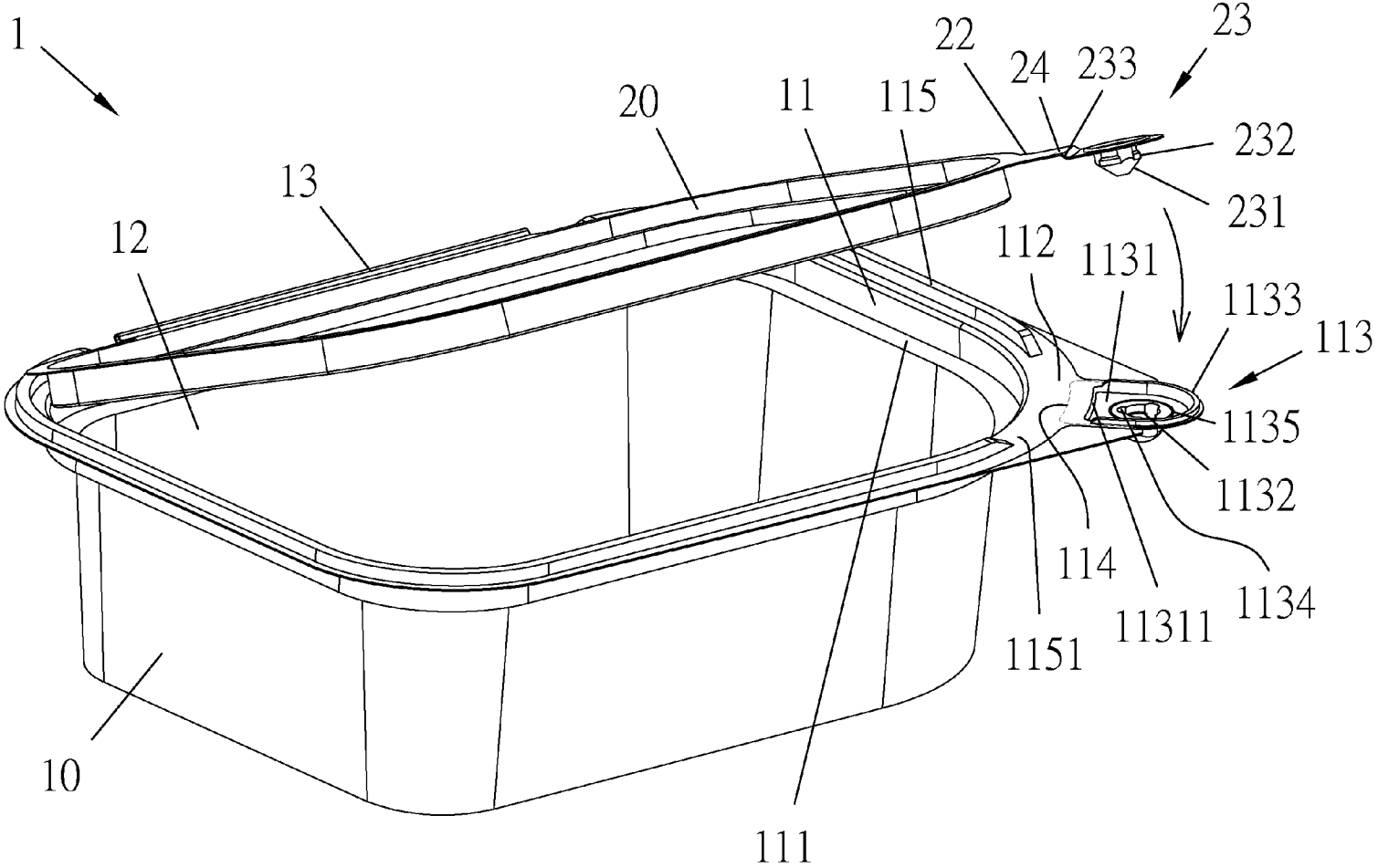
FIG. 1 is a perspective view showing the present invention in an unclosed condition.

Referring to FIG. 1, the present invention provides a tamper-evident container 1, which generally comprises a tray 10 and a cover 20, each of these elements being individually described as follows:

The tray 10: the tray 10 having an end that forms an opening 11 in communication with the outside, the tray 10 comprising a receiving space formed in an interior thereof and in communication with the opening 11, the opening 11 comprising a step section 111, the opening 11 being extended from at least one side thereof to form a first protrusion section 112, the first protrusion section 112 being provided with a first coupling unit 113, the first protrusion section 112 and the first coupling unit 113 being provided with a first perforation line 114 formed therebetween, the first coupling unit 113 comprising a shallow trough 1131, a coupling trough 1132, and a rim 1133 extending upward vertically, the coupling trough 1132 being formed inside the shallow trough 1131, the rim 1133 being formed one a circumference of the shallow trough 1131, the rim 1133 having an open end.

Figure 2:
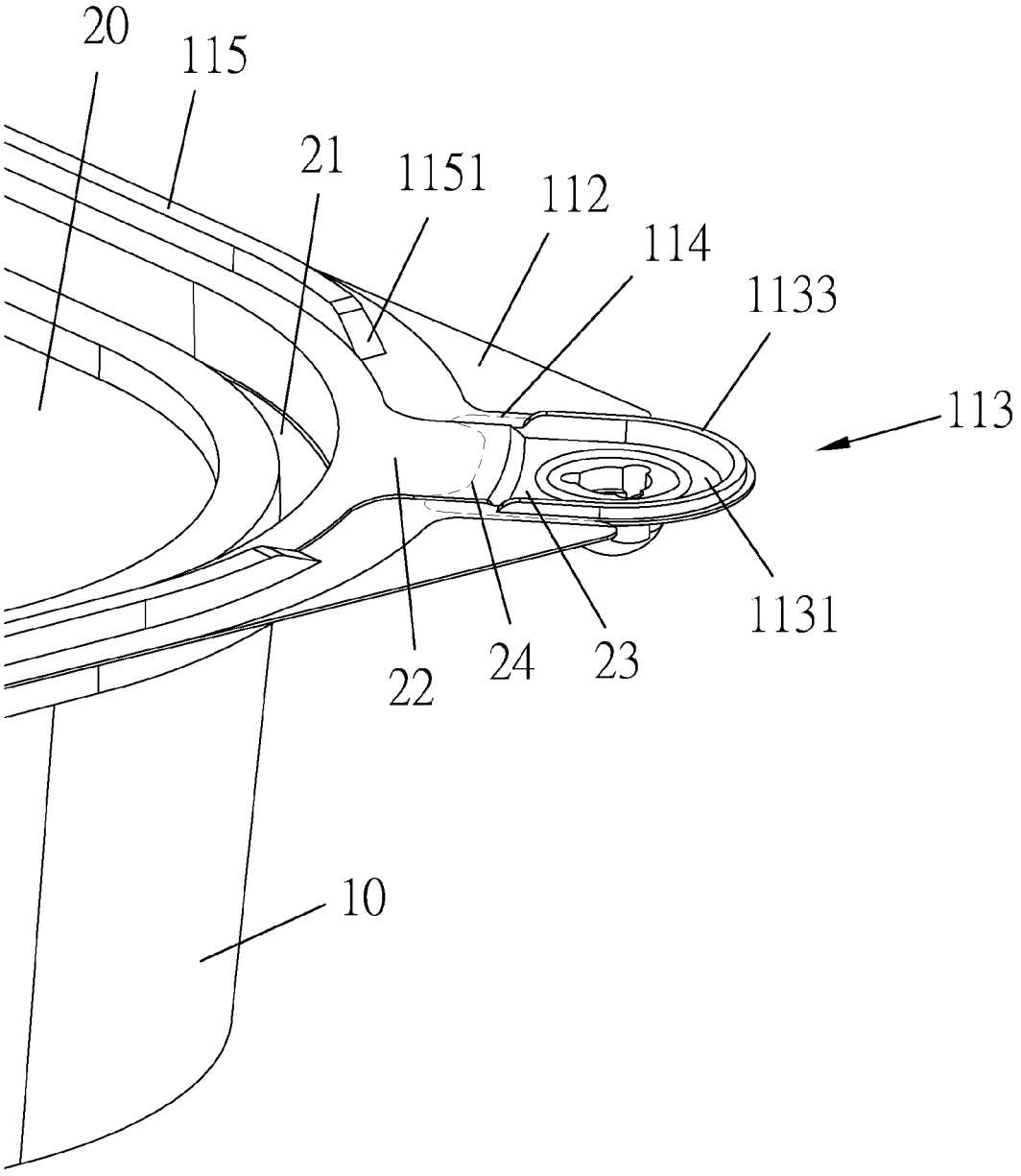
FIG. 2 is a perspective view showing, partly, the present invention in a closed condition.
Figure 3:
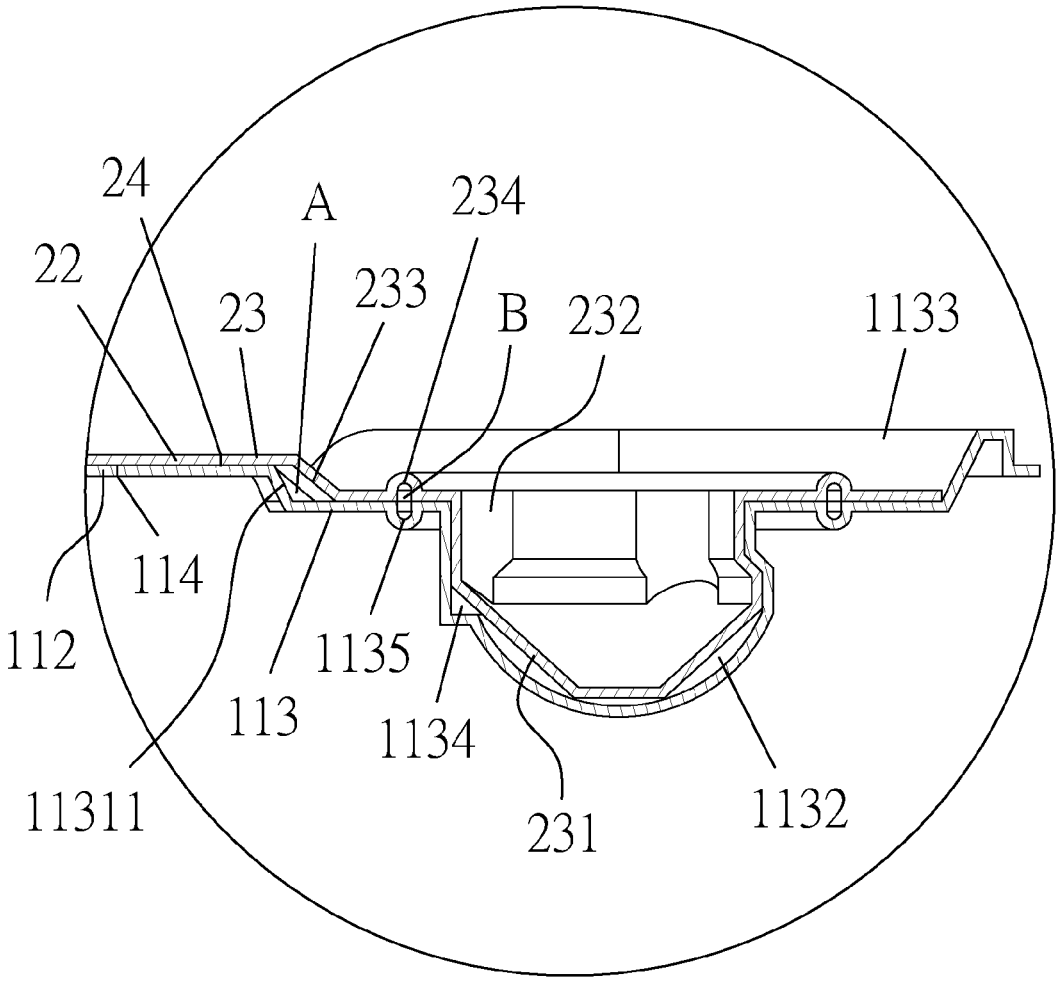
FIG. 3 is a cross-sectional view showing a portion of the present invention as shown in FIG. 2.
Figure 4:
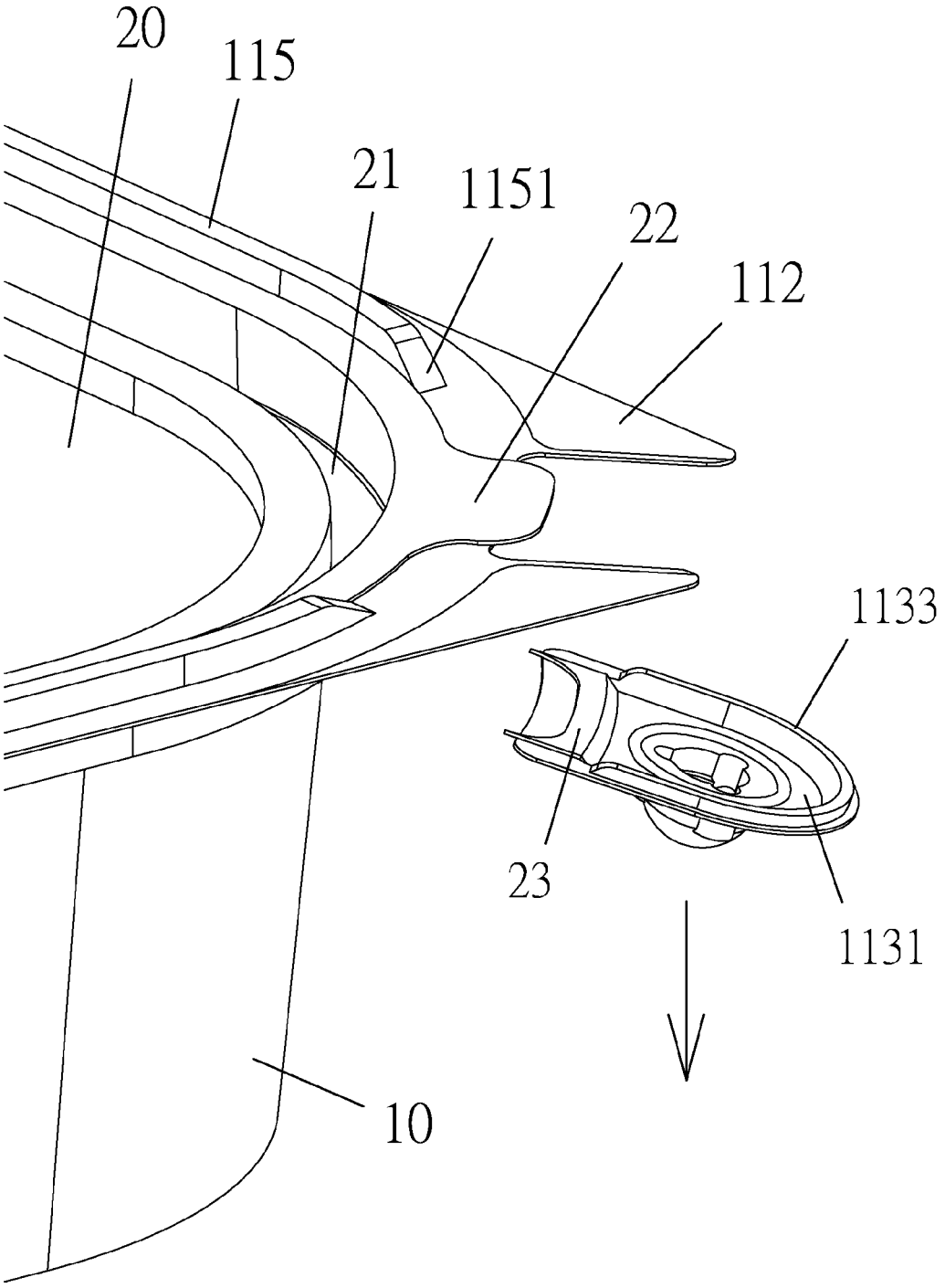
FIG. 4 is a schematic view illustrating a detached condition of the present invention.
Figure 5:
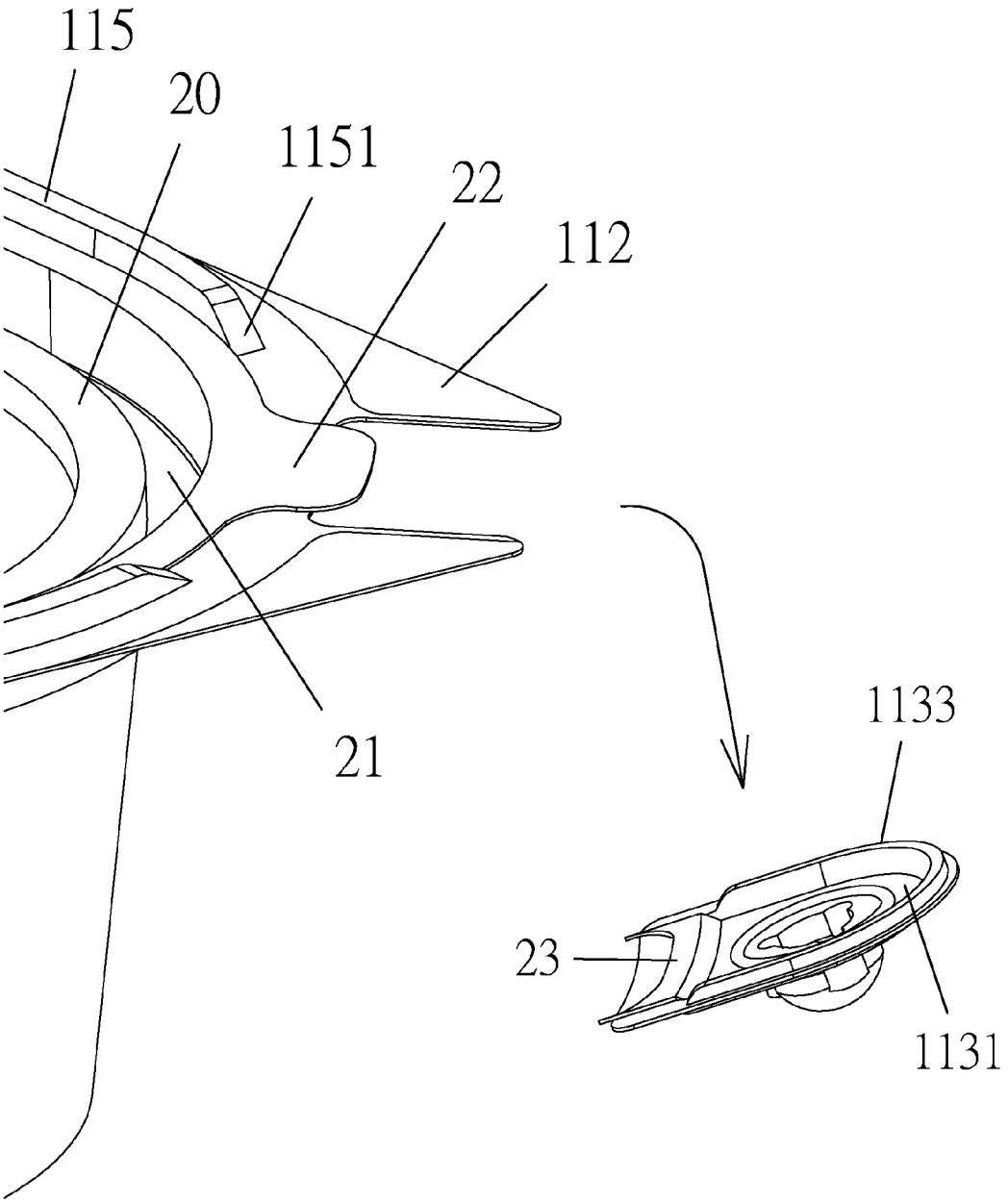
FIG. 5 is a schematic view illustrating a detached condition of the present invention.

Referring to FIGS. 1-3, the cover 20, which has a top surface in which a concave groove 21 is circumferentially formed, the concave groove 21 having a bottom and an outside surface engageable with the step section 111 to close the opening 11, the cover 20 being extended from one side thereof to form a second protrusion section 22 and a second coupling unit 23, the second protrusion section 22 and the second coupling unit 23 being provided with a second perforation line 24 formed therebetween, the second coupling unit 23 having a bottom comprising a coupling member 231 formed thereon and projecting therefrom, the coupling member 231 being receivable in and engageable with the coupling trough 1132 with the second perforation line 24 extending beyond and outside of the first perforation line 114, wherein one side of the tray 10 and one side of the cover 20 corresponding thereto are provided with a bendable section 13.

Referring to FIGS. 1-3, a stop section 115 is provided at an outer side of and circumferentially surrounds the step section 111. The stop section 115 comprises a notch 1151 formed therein and the notch 1151 is provided for receiving the second protrusion section 22 therein.

The coupling trough 1132 is further provided, in an inside wall thereof, with a plurality of recesses 1134, and the coupling member 231 is further provided, on an outside surface thereof, with a plurality of projections 232, such that the projections 232 are respectively engageable with and coupleable to the recesses 1134.

Referring to FIG. 3, the shallow trough 1131 of the first coupling unit 113 is provided with a first bent section 11311, and the second coupling unit 23 is provided with a second bent section 233, such that when the coupling member 231 and the coupling trough 1132 are engaged with each other, the first bent section 11311 and the second bent section 233 form therebetween a first air compartment A.

Further, the first coupling unit 113 is provided with a first circumferential slot 1135 circumferentially arranged around an outer side of the coupling trough 1132, and the second coupling unit 23 is provided with a second circumferential slot 234 circumferentially arranged around an outer side of the coupling member 231, such that when the coupling member 231 and the coupling trough 1132 are engaged with and coupled to each other, the first circumferential slot 1135 corresponds to the second circumferential slot 234 to allow the first circumferential slot 1135 and the second circumferential slot 234 to form therebetween a second air compartment B. Such a structure helps improve air tightness and structural strength and also prevent damage caused by thermal expansion and contraction resulting from temperature variation.

Referring to FIGS. 1-5, tearing off the first perforation line 114 and the second perforation line 24 allows the first coupling unit 113 and the second coupling unit 23 to detach from the tray 10 and the cover 20, respectively.

Figure 6:
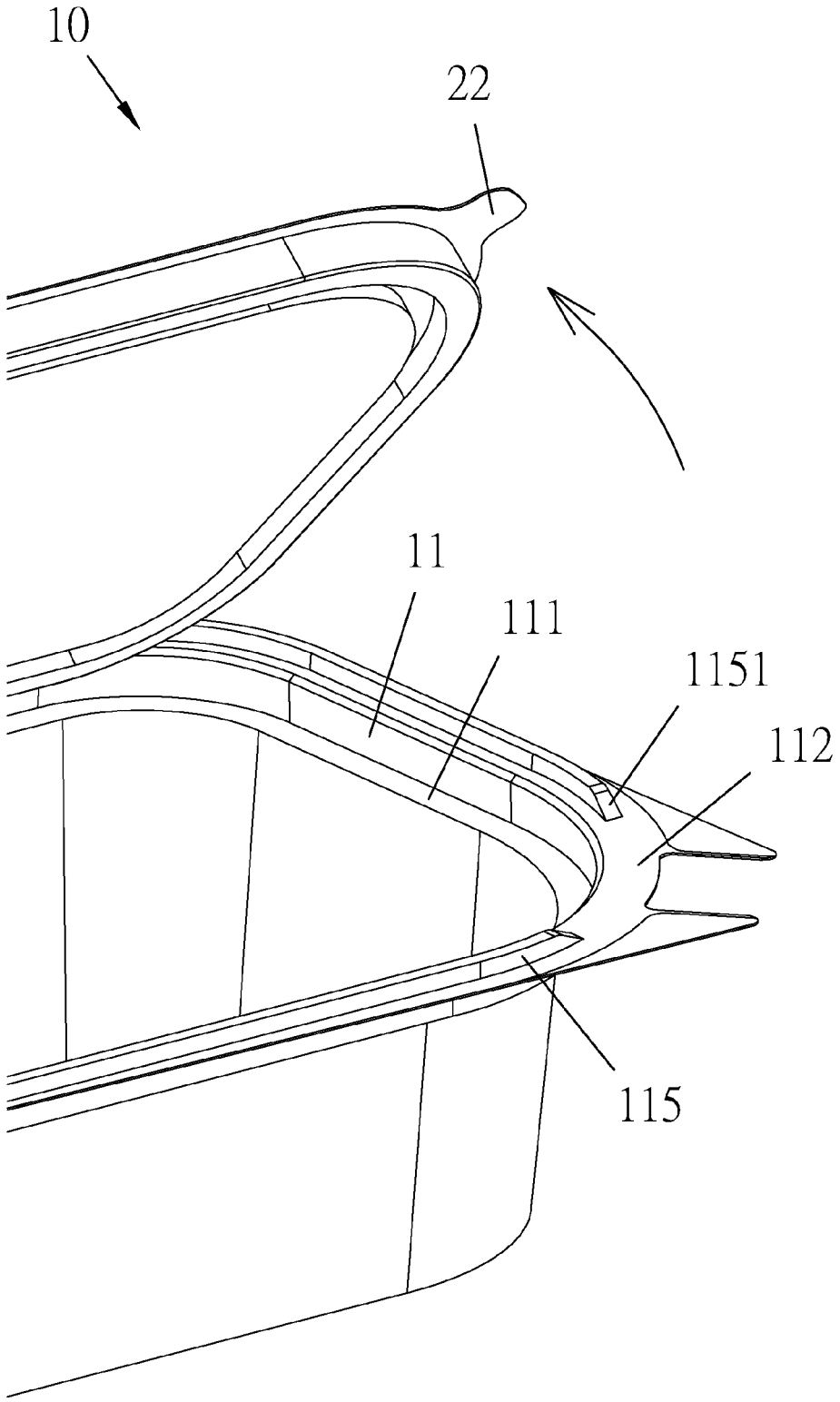
FIG. 6 is a view illustrating an opened condition of the present invention.

Referring to FIG. 6, while the first coupling portion 113 and the second coupling portion 23 can be torn apart and removed, the cover 20 may still maintain in contact engagement with the step section 111 by means of the bottom and the outside surface of the concave groove 21 to securely close the opening 11, and the second protrusion section 22 allows for gripping by a user to lift open the cover 20.

In summary, the present invention provides a tamper-evident container, which effectively alleviate various shortcoming of conventional plastic containers, and comprises a coupling member 231 and a coupling trough 1132 that are engageable with each other without being detachable from each other and may only be separated from each other by tearing off a first perforation line 114 and s second perforation line 24, this making it possible to clearly identify if unauthorized opening has been made. Thus, the present invention, which is more advanced and more convenient, is better fit to the needs of users.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A tamper-evident container, comprising:

a tray, the tray having an end that forms an opening in communication with the outside, the tray comprising a receiving space formed in an interior thereof and in communication with the opening, the opening comprising a step section, the opening being extended from at least one side thereof to form a first protrusion section, the first protrusion section being provided with a first coupling unit, the first protrusion section and the first coupling unit being provided with a first perforation line formed therebetween, the first coupling unit comprising a shallow trough, a coupling trough, and a rim extending upward vertically, the coupling trough being formed inside the shallow trough, the rim being formed on a circumference of the shallow trough, the rim having an open end; and a cover, which has a top surface in which a concave groove is circumferentially formed, the concave groove having a bottom and an outside surface engageable with the step section to close the opening, the cover being extended from one side thereof to form a second protrusion section and a second coupling unit, the second protrusion section and the second coupling unit being provided with a second perforation line formed therebetween, the second coupling unit having a bottom comprising a coupling member formed thereon and projecting therefrom, the coupling member being receivable in and engageable with the coupling trough with the second perforation line extending beyond and outside of the first perforation line, wherein tearing off the first perforation line and the second perforation line allows the first coupling unit and the second coupling unit to detach from the tray and the cover, respectively;

wherein a stop section is provided at an outer side of and circumferentially surrounds the step section and the stop section comprises a notch formed therein and the notch is provided for receiving the second protrusion section therein.

2. The tamper-evident container according to claim 1, wherein the coupling trough is further provided, in an inside wall thereof, with a plurality of recesses, and the coupling member is further provided, on an outside surface thereof, with a plurality of projections, such that the projections are respectively engageable with and coupleable to the recesses.

3. The tamper-evident container according to claim 1, wherein the shallow trough of the first coupling unit is provided with a first bent section, and the second coupling unit is provided with a second bent section, such that when the coupling member and the coupling trough are engaged with each other, the first bent section and the second bent section form therebetween a first air compartment.

4. The tamper-evident container according to claim 3, wherein the first coupling unit is provided with a first circumferential slot circumferentially arranged around an outer side of the coupling trough, and the second coupling unit is provided with a second circumferential slot circumferentially arranged around an outer side of the coupling member, such that when the coupling member and the coupling trough are engaged with and coupled to each other, the first circumferential slot corresponds to the second circumferential slot to allow the first circumferential slot and the second circumferential slot to form therebetween a second air compartment.

* * * * *